US006886254B1

(12) United States Patent
Pennella

(10) Patent No.: US 6,886,254 B1
(45) Date of Patent: May 3, 2005

(54) SHAVING APPARATUS

(75) Inventor: Andrew Pennella, Stamford, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 10/737,003

(22) Filed: Dec. 16, 2003

(51) Int. Cl.[7] ..... B26B 21/44
(52) U.S. Cl. ..... 30/41; 30/50
(58) Field of Search ..... 30/41, 41.5, 47, 30/50, 123, 124, 526, 527

(56) References Cited

U.S. PATENT DOCUMENTS

| | | | | | |
|---|---|---|---|---|---|
| 1,899,841 | A | | 2/1933 | Acken | 30/41 |
| 3,053,422 | A | | 9/1962 | Tenison | 222/399 |
| 3,703,765 | A | | 11/1972 | Perez | 30/41 |
| 3,726,009 | A | | 4/1973 | Hackmyer | 30/41 |
| 3,768,161 | A | * | 10/1973 | Miller | 30/41 |
| 4,023,269 | A | | 5/1977 | Lopez, Jr. | 30/41 |
| 4,077,119 | A | | 3/1978 | Sellera | 30/41 |
| 4,177,556 | A | | 12/1979 | Galli, Jr. | 30/41 |
| 4,377,034 | A | | 3/1983 | Druash et al. | 30/41 |
| 4,433,483 | A | | 2/1984 | Lazarus | 30/41 |
| 4,562,643 | A | | 1/1986 | Cataudella | 30/41 |
| 4,753,006 | A | | 6/1988 | Howe | 30/41 |
| 4,760,642 | A | | 8/1988 | Kwak | 30/123 |
| 4,791,723 | A | | 12/1988 | Jacobson | 30/41 |
| 4,809,432 | A | | 3/1989 | Schauble | 30/41 |
| 4,813,138 | A | | 3/1989 | Chen | 30/41 |
| 4,868,982 | A | | 9/1989 | McComas | 30/41 |
| 4,888,868 | A | | 12/1989 | Pritchard | 30/41 |
| 4,908,945 | A | | 3/1990 | Jacobson | 30/41 |
| 4,974,319 | A | | 12/1990 | Maguire, Jr. et al. | 30/41 |
| 5,014,427 | A | | 5/1991 | Byrne | 30/41 |
| 5,016,351 | A | | 5/1991 | Drahus | 30/41 |
| 5,092,041 | A | | 3/1992 | Podolsky | 30/41 |
| 5,103,560 | A | | 4/1992 | Podolsky | 30/41 |
| 5,134,775 | A | * | 8/1992 | Althaus et al. | 30/41 |
| 5,168,628 | A | | 12/1992 | Mock et al. | 30/41 |
| 5,234,140 | A | | 8/1993 | Demarest et al. | 222/394 |
| 5,384,961 | A | | 1/1995 | Gregory | 30/41 |
| 5,564,190 | A | | 10/1996 | Fleetwood | 30/41 |
| 5,673,485 | A | | 10/1997 | Hill | 30/41.5 |
| 5,701,674 | A | | 12/1997 | Mitchell | 30/41 |
| 5,761,813 | A | | 6/1998 | Frick et al. | 30/41 |

(Continued)

FOREIGN PATENT DOCUMENTS

| | | |
|---|---|---|
| GB | 2 246 314 A | 1/1992 |

(Continued)

OTHER PUBLICATIONS

Copy of PCT Search Report for Serial No. PCT/IB03/01144 dated Oct. 29, 2003.

*Primary Examiner*—Hwei-Siu Payer
(74) *Attorney, Agent, or Firm*—Michaud-Duffy Group LLP

(57) ABSTRACT

A shaving apparatus is provided that is selectively attachable to a handle. The cartridge includes a razor cartridge and a device for dispensing a non-solid shaving aid material. The shaving apparatus attaches to the handle in such a manner that a self-leveling mechanism contained within the handle is not operable to adjust the movement of a first element relative to a second element.

21 Claims, 5 Drawing Sheets

U.S. PATENT DOCUMENTS

| | | | | |
|---|---|---|---|---|
| 5,855,066 | A | 1/1999 | Manger | 30/41 |
| 5,903,979 | A * | 5/1999 | Oldroyd | 30/41 |
| 5,983,500 | A | 11/1999 | da Silva | 30/41 |
| 6,115,924 | A * | 9/2000 | Oldroyd | 30/527 |
| 2003/0200660 | A1 * | 10/2003 | Pennella et al. | 30/47 |
| 2004/0177510 | A1 * | 9/2004 | Pennella | 30/41 |
| 2004/0181949 | A1 * | 9/2004 | Coffin et al. | 30/346.57 |

FOREIGN PATENT DOCUMENTS

| | | |
|---|---|---|
| JP | 10-165668 | 6/1998 |
| JP | 2003210874 | 7/2003 |
| WO | WO 00/10780 | 3/2000 |
| WO | WO 00/47374 | 8/2000 |
| WO | WO 02/32253 A1 | 4/2002 |

* cited by examiner

SHAVING APPARATUS

BACKGROUND OF THE INVENTION

1. Field of the Invention

The present invention relates to shaving devices and, more particularly, to shaving devices having apparatus for dispensing a non-solid shaving aid material.

2. Background Information

Conventional safety razors typically include a disposable razor cartridge mounted in a reusable handle, or a handle and cartridge combined into a unitary disposable unit. Most razor cartridges include a frame, at least one razor blade, and a strip of shaving aid material attached to the frame. Shaving aid materials include, but are not limited to lubricating agents, drag reducing agents, depilatory agents, cleaning agents, medicinal agents, and the like that enhance the shaving process. The strip of shaving aid material is typically attached to the razor cartridge adjacent to the razor blade(s). An additional shaving aid material (e.g., a shaving cream) is also typically used with the razor cartridge.

Shaving aid material strips typically comprise a water-soluble material that is intended to be dispensed during the act of shaving, and a water-insoluble material that is not intended to be dispensed during shaving. The water-insoluble material provides a medium for supporting and/or holding the water-soluble material. An example of a water-insoluble material is a polystyrene, and an example of a water-soluble material is a polyox-type material. Both of these types of materials are well known in the art.

Several disadvantages are often associated with some shaving aid strips. For example, the useful life of shaving aid strips can vary significantly depending on the shaving habits of the user, and the environment in which the razor cartridge is being used and/or stored. The amount of shaving aid material being dispensed can also vary over the life of the shaving device. Consequently, an initially adequate dispersion rate may subsequently become inadequate. In addition, the types of shaving aid material that can be dispensed in a shaving aid strip are limited.

Therefore, it would be desirable to provide a shaving device that overcomes these shortcomings in the art.

SUMMARY OF THE INVENTION

According to the present invention, a shaving apparatus includes a base, a shaving aid dispensing device, and a razor cartridge. The base includes a first side and a second side. The shaving aid dispensing device and the razor cartridge are mounted on the first side of the base. In some embodiments, the base includes connectors for selectively connecting the shaving apparatus to a handle. The shaving aid dispensing device includes an inner wall and an outer wall that define at least one reservoir. The inner wall defines an aperture sized for passing the razor blade cartridge therethrough. A storage medium is disposed in, and substantially fills, the reservoir. The storage medium is operable to store a shaving aid material. A wick substantially covers the reservoir and is operable to draw the shaving aid material from the storage medium by capillary action. In one embodiment, the above-described shaving apparatus is provided with a handle. In other embodiments, the shaving apparatus is provided in a form that can be used as a replacement cartridge selectively attachable to a handle.

An advantage of the present invention is that it is operable with shaving aid material that is in a variety of non-solid forms; e.g., liquid, cream, gel, etc.

Another advantage of the present invention is that the shaving aid dispensing device does not require the user to operate an independent mechanism to dispense the shaving aid material from the dispensing device.

A further advantage of the present invention is that shaving aid material can be applied from the present invention "on demand".

Some embodiments of the present invention provide the further advantage of allowing a shaving aid dispensing device that dispenses a non-solid shaving aid to be used with a handle that was designed to be used with a solid shaving aid.

The foregoing and other advantages of the present invention will become more apparent in light of the following detailed description of the present invention and accompanying drawings.

DETAILED DESCRIPTION OF THE PRESENT INVENTION

Figure 1:
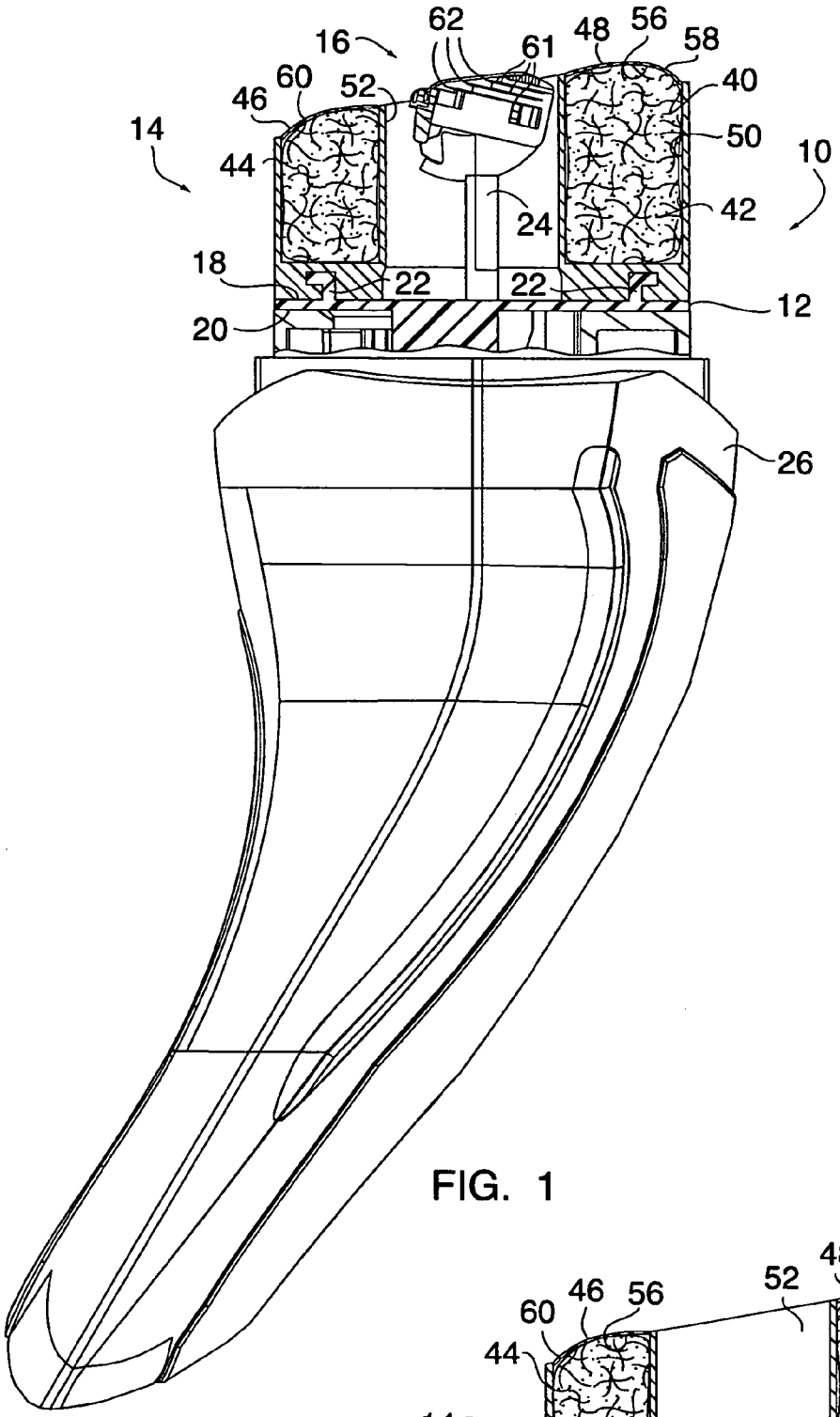
FIG. 1 is a side sectional view of a shaving apparatus of the present invention mounted on a handle.
Figure 2:
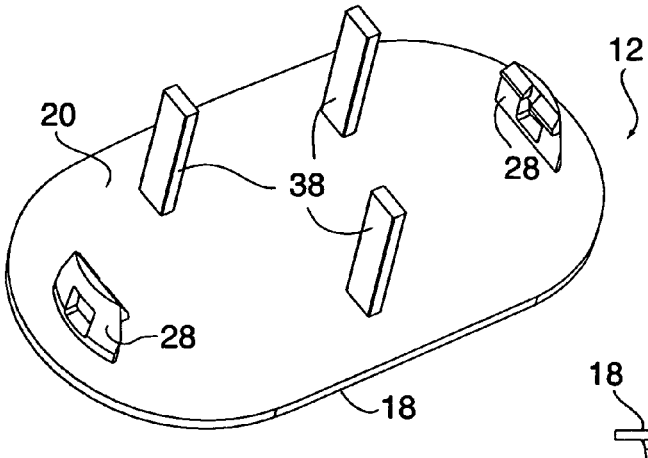
FIG. 2 is a bottom perspective view of a base of the present invention.
Figure 3:
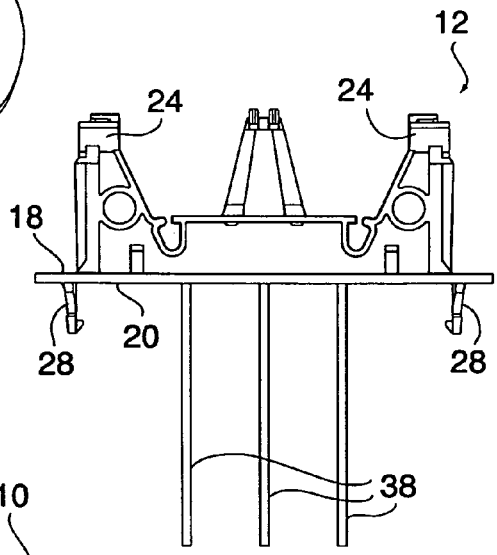
FIG. 3 is a front view of the base of FIG. 2.

Referring to FIG. 1, the present invention shaving apparatus 10 includes a base 12, a shaving aid dispensing device 14 and a razor cartridge 16. In FIG. 1 the shaving apparatus is shown mounted on a handle 26, or portions of the handle. Referring to FIGS. 2–3, the base 12 includes a first side 18 and a second side 20. The base includes connectors 22 disposed on the first side 18 of the base 12 operable to selectively attach the base 12 and the shaving aid dispensing device 14 together as will be discussed below. Alternative means may be used to attach the shaving aid dispensing device 14 to the base 12; e.g., adhesives, etc. The base further includes connectors 24 operable to selectively attach the razor cartridge 16 to the first side 18 of the base 12. Alternative means can be used to attach the razor cartridge 16 to the base 12. The base 12 may be a unitary structure or a multiple piece structure. The second side 20 of the base 12 is adapted to connect to a handle 26 for example by connectors 28.

Now referring to FIG. 4 the second side 20 of the base 12 is shown mounted to a handle 26 having a linkage (hereinafter referred to as "self-leveling" mechanism 30) that is normally intended to connect a razor cartridge and a shaving aid body in a manner that allows the razor cartridge and the shaving aid body to move relative to the handle 26. Specifically, movement of one of the razor cartridge or the shaving aid body in a first direction causes the other of the razor cartridge or the shaving aid body to move in a second direction substantially opposite the first direction. The shaving plane of the razor cartridge and the contact surface of the shaving aid body consequently self-level so that they may remain substantially co-planar. Examples of such mechanisms can be found within U.S. patent application Ser. No. 10/367,255 which is hereby incorporated by reference.

Figure 5:
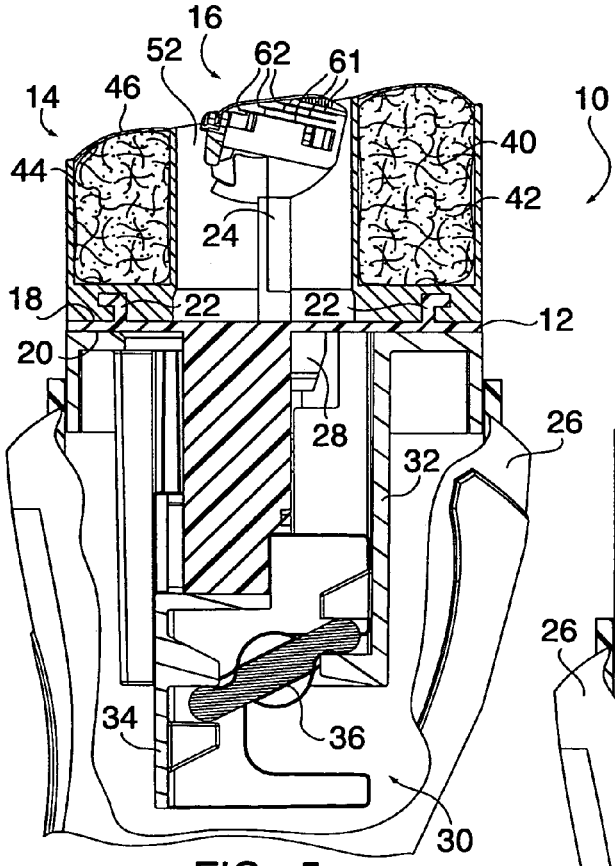
FIG. 5 is a side sectional view of a shaving apparatus of the present invention.
Figure 4:
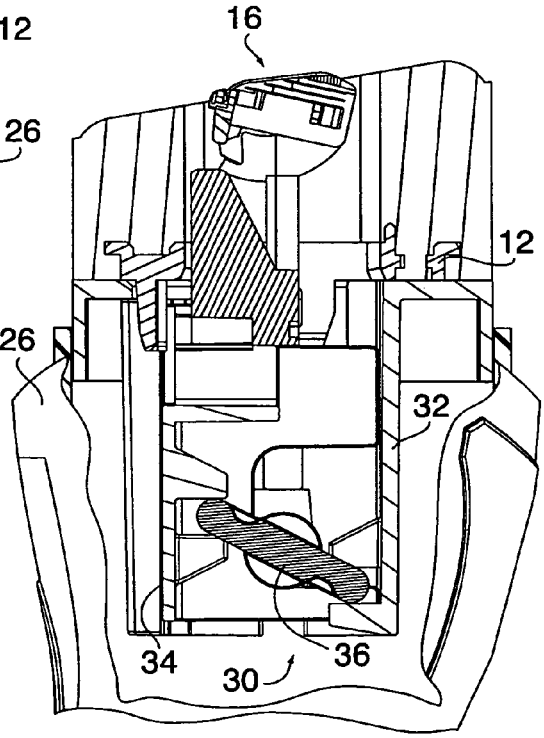
FIG. 4 PRIOR ART
FIG. 4 is a side sectional view showing a prior art shaving apparatus.

In the embodiment shown in FIGS. 4 and 5, the self-leveling mechanism 30 includes a first carriage 32, a second carriage 34, and a pivot link 36 disposed between and engaged with the first and second carriages 32, 34, and pivotally mounted to the handle 26. Because the pivot link 36 is disposed between the carriages 32,34 and pivotally mounted to the handle 26, movement of one of the carriages 32,34 in a first direction causes the other of the carriages 34,32 to move in a second direction substantially opposite the first direction. The self-leveling mechanism 30 enables a contact surface of a solid shaving aid body to remain substantially adjacent a razor cartridge 16 during use. The above-described self-leveling mechanism 30 embodiment is provided for illustration purposes, and the present invention is not limited to use with such an embodiment.

The motion of a self-leveling device typically extends between two extreme positions: e.g., a retracted position, where the carriages 32,34 are each at or near one end of their travel (as shown in FIG. 4), and an extended position, where the carriages 32,34 are at, or near, the opposite end of their travel (as shown in FIG. 5).

When the present invention shaving apparatus 10 is used with a handle 26 having a self-leveling mechanism 30, the apparatus 10 attaches to the handle 26 in such a way that the self-leveling mechanism 30 is fixed and therefore inoperable. In terms of the self-leveling mechanism 30 described above, the base 12 is attached to one of the carriages 32,34 and one or more members 38 extending out from the base 12 prevent movement of the carriages 32,34 relative to one another.

Referring back to FIG. 1, the shaving aid dispensing device 14 includes a reservoir 40, a storage medium 42, a shaving aid material 44, and a wick 46. The shaving aid dispensing device 14 also includes an inner wall 48 and an outer wall 50 that define the reservoir 40. The inner wall 48 further defines an aperture 52 sized for passing the razor cartridge 16 therethrough. The outer shape of the shaving aid dispensing device 14 is defined by the outer wall 50 and may be of any shape. An oval shaped dispensing device, shaped substantially similar to the base 12, has particular utility.

Figure 6:
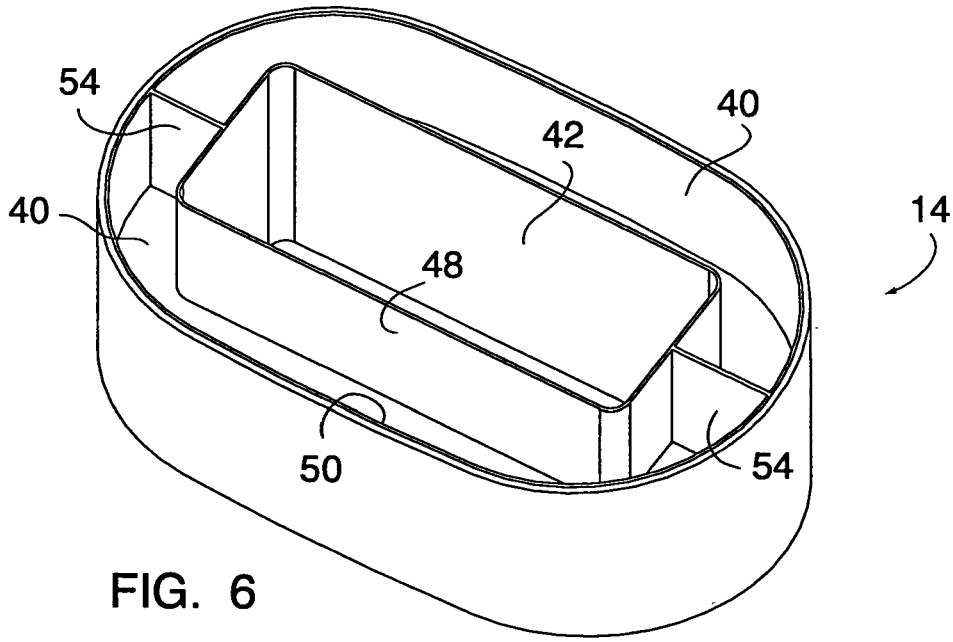
FIG. 6 is a perspective view of the shaving aid dispensing device of the present invention.
Figure 6A:
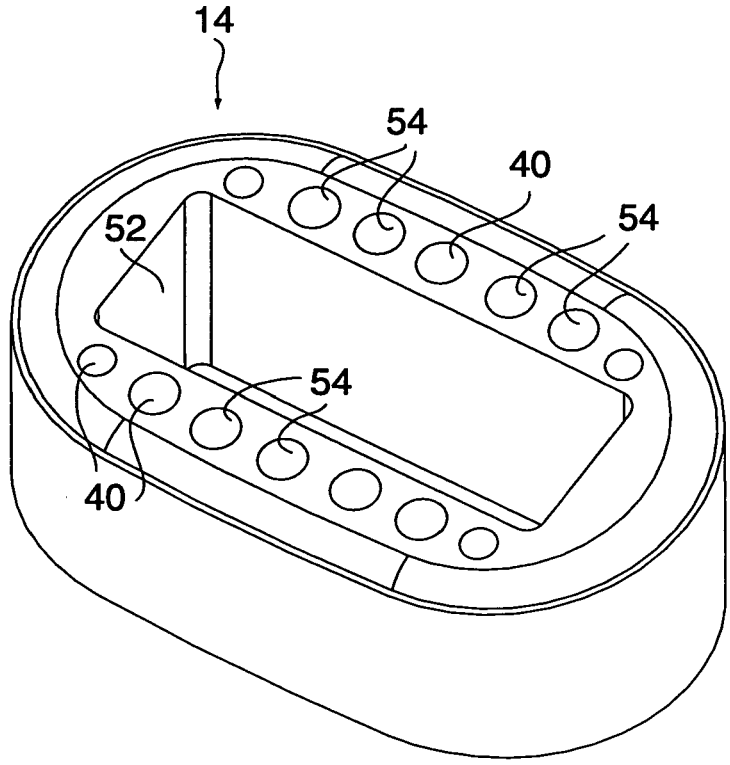
FIG. 6A is a perspective view of a shaving aid dispensing device having a plurality of reservoirs.

Referring to FIGS. 6 and 6A, the shaving aid dispensing device 14 may further include one or more reservoir walls 54. The reservoir walls 54 are used to divide the shaving aid dispensing device 14 into two or more distinct reservoirs 40. Referring to FIG. 6A, the reservoir walls 54 may also be used to reduce the size of the reservoir(s) 40. In embodiments having more than one reservoir 40, the reservoirs 40 may be of different sizes and shapes.

Figure 8:
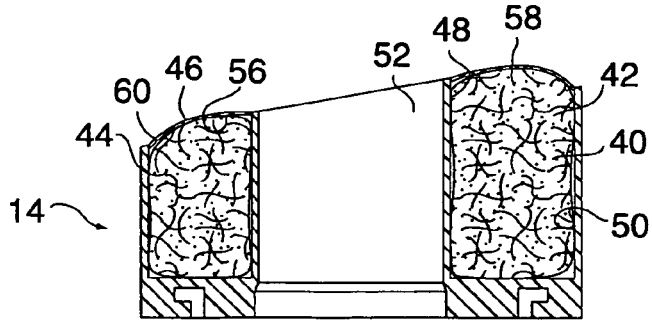
FIG. 8 is a side sectional view of the shaving aid dispensing device taken along line 8—8 of FIG. 7.

Referring to FIG. 8, the storage medium 42 is disposed in the reservoir 40. Fibrous materials are an example of an acceptable storage medium 42. Other examples of acceptable storage mediums 42 include, but are not limited to, spun or extruded fiber, such as wool, fiberfill, cellulose or acetate. In embodiments where more than one reservoir 40 is present, more than one type of storage medium 42 may be utilized. Typically, the storage medium 42 substantially fills the reservoir 40 in which it is located.

The shaving aid material 44 is distributed in the storage medium 42. The term "shaving aid" as used herein is intended to refer to any non-solid substance that aids in the preparation for, or treatment of the skin before, during, or after shaving. For example, commonly known non-solid shaving aid materials 44 include shaving creams, soaps, gels and liquids, as well as after shave liquids, lotions, creams and gels. This list is not to be considered all-inclusive of non-solid shaving aid materials 44 known to those skilled in the art. In embodiments where more than one reservoir 40 is present, such as in FIGS. 6A and 6B, various shaving aid materials 44 may be distributed in the storage mediums 42 of the different reservoirs 40.

A wick 46 having an inner surface 56 and an outer surface 58 is placed on the shaving aid dispensing device 14, substantially covering the reservoir 40. The inner surface 56 of the wick 46 is positioned so that it remains in contact with the storage medium 42. The wick 46 is operable to draw the shaving aid material 44 from the storage medium 42 by capillary action to the outer surface 58 of the wick 46. The term "capillary action," as used herein, refers to the natural action of a non-solid through a wick 46 caused by adhesive and cohesive forces between the two substances, wherein the non-solid material travels through the wick 46. The porosity of the wick 46 and the properties of the shaving aid material 44 are factors that influence the rate at which the shaving aid material 44 is drawn through the wick 46. The wick 46 is preferably made of fibrous material. The characteristics of the wick 46 can be altered to produce a desired flow rate for a particular shaving aid material 44 under a given set of circumstances. In some applications, the wick 46 may be made of a substantially similar material as the storage medium 42.

In embodiments where more than one reservoir 40 is present, such as in FIGS. 6 and 6A, a plurality of wicks 46 of the same or different materials may be utilized.

Depending on the intended use of the end product, the wick 46 may be permanently affixed over the reservoir 40, or removably attached to the shaving aid dispensing device 14. In embodiments where the wick 46 is removably attached to the shaving aid dispensing device 14, the wick 46 is selectively removable from the reservoir 40 to permit replenishment of shaving aid material 44 in the storage medium 42. Alternatively, in the some embodiments, the wick 46 can be selectively removed and a depleted storage medium 42 can be replaced with a new storage medium 42 filled with shaving aid material 44 and a new wick 46, if desired.

Figure 7:
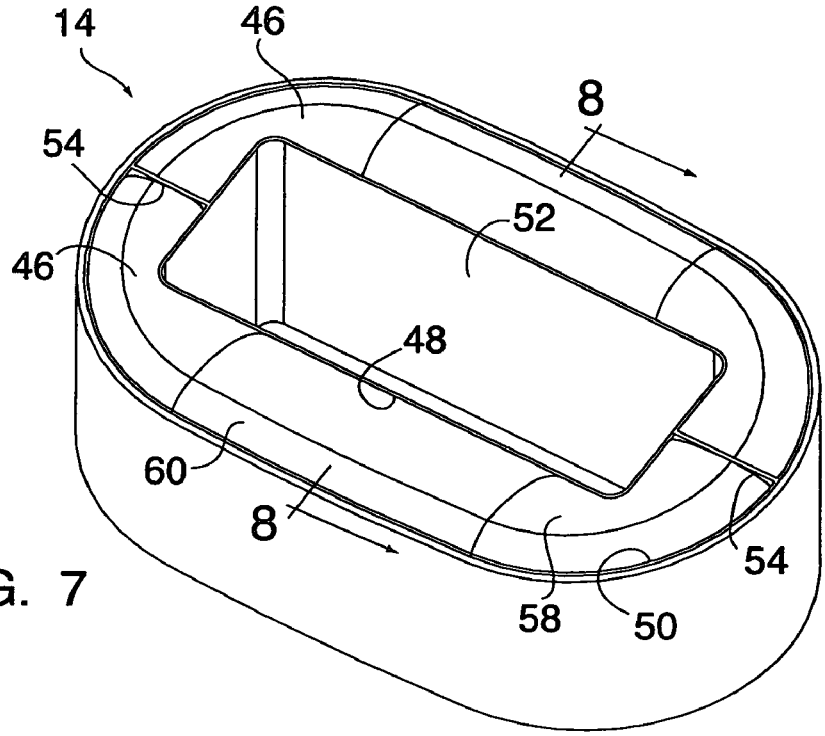
FIG. 7 is a perspective view of the present shaving aid dispensing device of FIG. 6 with the wick present.
Figure 7A:
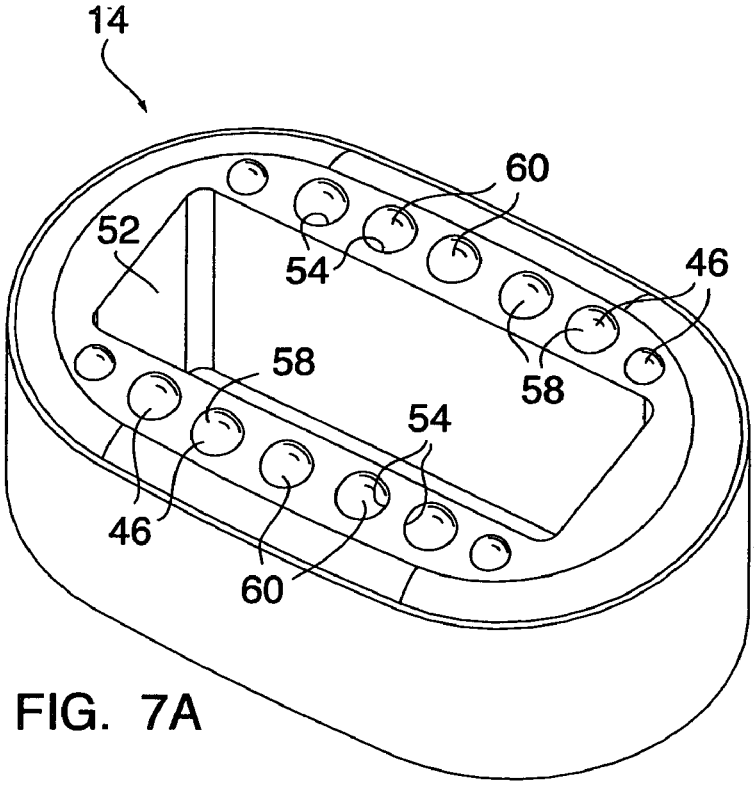
FIG. 7*a* is a perspective view of the present shaving aid dispensing device of FIG. 6*a* with the wick present.

The wick 46 is also preferably, but not necessarily, moldable and shaped to have an outwardly rounded outer surface 60 as shown, for example, in FIGS. 7 and 7A. The outwardly rounded outer surface 60 facilitates contact between the surface to be shaved and the outer surface 58 of the wick 46, thereby causing the wick 46 to draw the shaving aid material 44 from the storage medium 42, through the wick 46.

Referring back to FIGS. 1 and 5, the razor cartridge 16 has one or more razor blades 61, each having at least one cutting edge 62. The razor cartridge 16 is positioned in the aperture 52 and is substantially surrounded by the inner wall 48. The razor cartridge 16 is positioned in such a manner that at least a portion of the cutting edge 62 protrudes outwardly through, or is adjacent, the aperture 52. The outer surface 58 of the wick 46 is typically substantially adjacent the cutting edge(s) 62 of the razor cartridge 16. Such positioning allows the user to place the outer surface 58 of the wick 46 and the cutting edge(s) 62 of the razor cartridge 16 in contact with the surface to be shaved at the same time. As mentioned, the razor cartridge 16 is mounted to the first side 18 of the base 12. In some embodiments, the razor cartridge 16 is pivotally mounted on the base 12 so that the razor cartridge 16 is capable of substantially conforming to the surface being shaved.

In some embodiments, the razor cartridge 16 has a plurality of cutting edges 62 that are oriented so that at least one cutting edge 62 is aligned to shave in a substantially different direction than at least one other cutting edge 62. The present invention is not limited to linear razor blades and can be used with non-linear shaped razor blades (e.g. round, oblong, etc.) although the multi-direction cutting edges 62 are shown as different geometrical shapes to achieve multi-directional shaving.

The present invention is described above in terms of a shaving apparatus 10 having a razor cartridge 16. However, as discussed below, the razor cartridge 16 is releasably attached to the base 12 in some embodiments, permitting the present invention to be utilized with different razor cartridges 16.

In operation of the present invention, the user selectively attaches the shaving apparatus 10 of the present invention to the handle 26 by connecting matching connectors 28 of the base 12 and the handle 26. The user brings the outer surface 58 of the wick 46 and the razor blades cutting edge(s) 62 of the razor cartridge 16 in contact with the surface to be shaved. As the user moves the shaving apparatus 10 across the area to be shaved, the wick 46 operates to draw the shaving aid material 44 from the storage medium 42 through the wick 46 by capillary action, thereby delivering the shaving aid material 44 directly to the area being shaved. Simultaneously, as the user moves the shaving apparatus 10 across the area to be shaved, the cutting edge(s) 62 operate to shave the undesired hair from the area.

Figure 9:
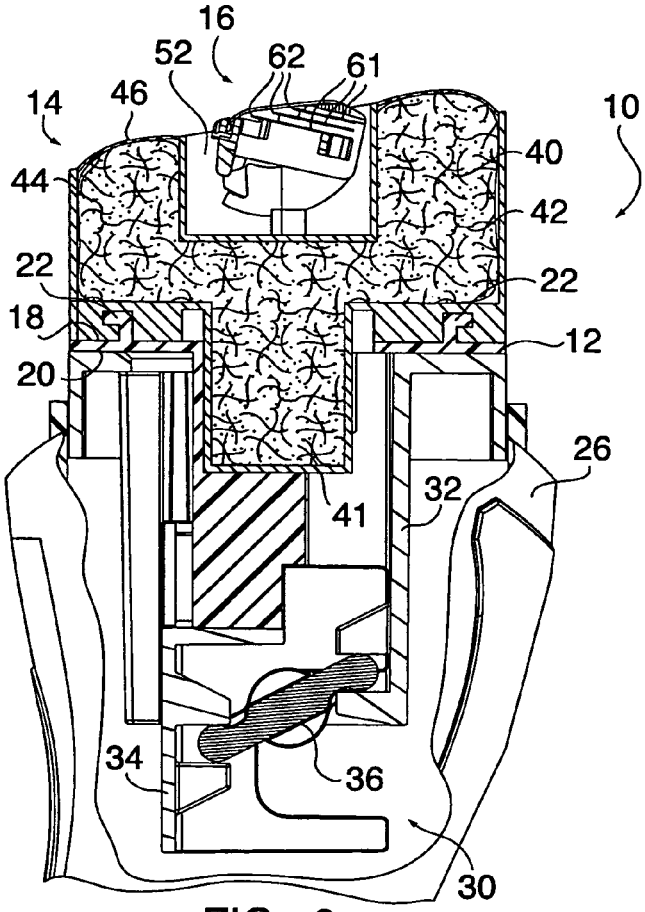
FIG. 9 is a side sectional view of the present invention that includes an alternative embodiment of the present shaving aid dispensing device.
Figure 9A:
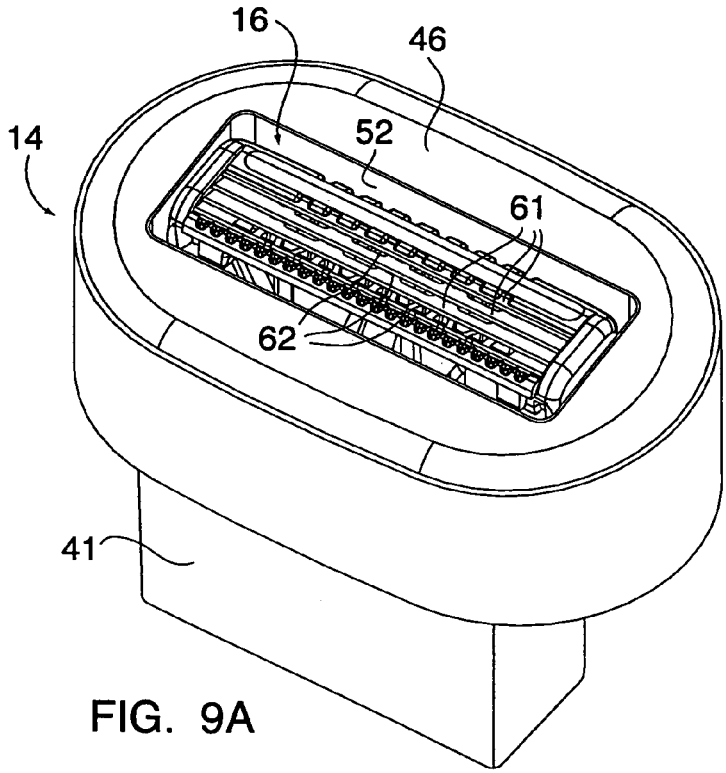
FIG. 9A is a diagrammatic perspective view of base, razor cartridge, and dispensing device portions of the alternative embodiment of the present shaving aid dispensing device shown in FIG. 9.

Referring to FIGS. 9 and 9A, in an alternative embodiment, the base 12 and the dispensing device 14 are incorporated to accommodate an enlarged reservoir 40. The enlarged reservoir has an additional portion 41 sized to be received within the handle 26. The additional reservoir portion 41 is preferably shaped to engage the carriages 32,34 and prevent movement of the carriages 32,34 relative to one another. As a result, the self-leveling mechanism 30 is fixed positionally.

While the present invention has been illustrated and described with respect to a particular embodiment thereof, those of ordinary skill in the art should appreciate that various modifications to this invention may be made without departing from the spirit and scope of the present invention.

What is claimed is:

1. A shaving apparatus, comprising:

a base having a first side and a second side, the second side of the base including connectors for selectively attaching the shaving apparatus to a handle;

a razor cartridge mounted to the first side of the base;

a shaving aid dispensing device that includes at least one reservoir defined by an inner wall and an outer wall, wherein the inner wall further defines an aperture for passing the razor cartridge therethrough;

a storage medium disposed in the reservoir, for storing a non-solid shaving aid material; and a wick substantially covering the reservoir, wherein the wick is operable to draw shaving aid material from the storage medium by capillary action.

2. The shaving apparatus of claim 1, wherein the base is comprised of at least two separate elements.

3. The shaving apparatus of claim 1 having at least two reservoirs, wherein the reservoirs are separated by reservoir walls.

4. The shaving apparatus of claim 1 wherein the storage medium substantially fills the reservoir.

5. The shaving apparatus of claim 4 wherein the storage medium is in contact with an inner surface of the wick.

6. The shaving apparatus of claim 5 wherein the storage medium comprises a fibrous material.

7. The shaving apparatus of claim 6 wherein the storage medium comprises an extruded fiber.

8. The shaving apparatus of claim 6 wherein the storage medium comprises a spun fiber.

9. The shaving apparatus of claim 1 wherein the wick is moldable.

10. The shaving apparatus of claim 1 wherein the razor cartridge is selectively attachable to the base.

11. A shaving apparatus, comprising:

a base;

a razor cartridge attached to the base;

a shaving aid dispensing device that includes an annular shaped reservoir and an aperture;

a storage medium disposed in the reservoir, for storing a non-solid shaving aid material; and a wick substantially covering the reservoir, wherein the wick is operable to draw shaving aid material from the storage medium by capillary action.

12. A shaving apparatus, comprising:

a handle having a self-leveling mechanism that is normally operable to adjust the position of a first element relative to a second element, wherein movement of the first element in a first direction causes the second element to move in a second direction substantially opposite the first direction; and a replacement cartridge selectively attached to the handle, the replacement cartridge having a razor cartridge and a device for dispensing a non-solid shaving aid material, wherein the replacement cartridge attaches to the handle in such a manner that the self-leveling mechanism is not operable to adjust the movement of the first element relative to the second element.

13. The shaving apparatus of claim 12, wherein the replacement cartridge selectively attached to the handle comprises:

a base having a first side and a second side, the second side of the base including connectors for selectively attaching the base to the handle;

wherein the razor cartridge is attached to the base; and wherein the dispensing device is attached to the base, and the dispensing device includes at least one reservoir defined by an inner wall and an outer wall, wherein the inner wall further defines an aperture for receiving the razor cartridge, a storage medium disposed in the reservoir for storing a non-solid shaving aid material, and a wick substantially covering the reservoir, wherein the wick is operable to draw shaving aid material from the storage medium by capillary action.

14. The shaving apparatus of claim 13 wherein the dispensing device includes at least two reservoirs, wherein the reservoirs are separated by reservoir walls.

15. The shaving apparatus of claim 13 wherein the storage medium substantially fills the reservoir.

16. The shaving apparatus of claim 15 wherein the storage medium is in contact with an inner surface of the wick.

17. The shaving apparatus of claim 16 wherein the storage medium comprises a fibrous material.

18. The shaving apparatus of claim 17 wherein the storage medium comprises an extruded fiber.

19. The shaving apparatus of claim 17 wherein the storage medium comprises a spun fiber.

20. The shaving apparatus of claim 13 wherein the wick is moldable.

21. The shaving apparatus of claim 13, wherein the dispensing device is incorporated with a base that selectively attaches to the handle.

* * * * *